US008226182B2

(12) United States Patent
Park et al.

(10) Patent No.: US 8,226,182 B2
(45) Date of Patent: Jul. 24, 2012

(54) REFRIGERATOR

(75) Inventors: Yoo-Min Park, Jinju-si (KR); Jong-Gon Kim, Changwon-si (KR); Young-Hoon Gwak, Changwon-si (KR); Bon-Young Koo, Changwon-si (KR); Myung-Soo Kim, Gimhae-si (KR); Hyeon-Po Cho, Changwon-si (KR); Oh-Chul Kwon, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 572 days.

(21) Appl. No.: 12/296,823

(22) PCT Filed: Apr. 13, 2007

(86) PCT No.: PCT/KR2007/001804

§ 371 (c)(1),
(2), (4) Date: Apr. 3, 2009

(87) PCT Pub. No.: WO2007/119976

PCT Pub. Date: Oct. 25, 2007

(65) Prior Publication Data

US 2009/0309472 A1 Dec. 17, 2009

(30) Foreign Application Priority Data

Apr. 14, 2006 (KR) ..... 10-2006-0034219

(51) Int. Cl.
*A47B 96/04* (2006.01)
*A47B 88/00* (2006.01)

(52) U.S. Cl. ..... 312/404; 312/334.44

(58) Field of Classification Search ..... 312/402–404, 312/408, 410, 333, 334.1, 334.7, 330.1, 334.44–334.47
See application file for complete search history.

(56) References Cited

U.S. PATENT DOCUMENTS

| | | | | | |
|---|---|---|---|---|---|
| 843,194 | A | * | 2/1907 | Coolbaugh | 312/294 |
| 1,716,242 | A | * | 6/1929 | Ritsche | 312/294 |
| 1,861,123 | A | * | 5/1932 | Kuckel | 312/293.2 |
| 1,975,327 | A | * | 10/1934 | Loney | 312/408 |
| 2,254,832 | A | * | 9/1941 | Weight | 312/233 |
| 2,573,272 | A | * | 10/1951 | Petkwitz | 312/404 |
| 2,755,158 | A | * | 7/1956 | Davidson | 312/404 |
| 3,106,072 | A | * | 10/1963 | Muffly | 62/126 |
| 5,820,239 | A | * | 10/1998 | Christenson et al. | 312/334.23 |
| 6,250,730 | B1 | * | 6/2001 | Roth et al. | 312/333 |
| 2005/0162054 | A1 | * | 7/2005 | Jackson | 312/334.44 |

FOREIGN PATENT DOCUMENTS

| | | | |
|---|---|---|---|
| CN | 1079531 | C | 2/2002 |
| KR | 20-0109836 | Y1 | 9/1995 |
| KR | 1995-0025571 | A | 9/1995 |
| KR | 10-1998-0008047 | | 3/1998 |
| KR | 10-1999-0074444 | B1 | 10/1999 |
| WO | WO 2005/083339 | A1 | 9/2005 |

* cited by examiner

*Primary Examiner* — Darnell Jayne
*Assistant Examiner* — Timothy M Ayres
(74) *Attorney, Agent, or Firm* — Birch, Stewart, Kolasch & Birch, LLP

(57) ABSTRACT

Disclosed related to a refrigerator according to the present invention capable of preventing the drooping of bin when the bin is pulled out of the storage space. Further, the refrigerator does not need to fit guide device when users push the bin into the storage space, since the bin is completely separated from the guide device.

8 Claims, 3 Drawing Sheets

[Fig. 1]
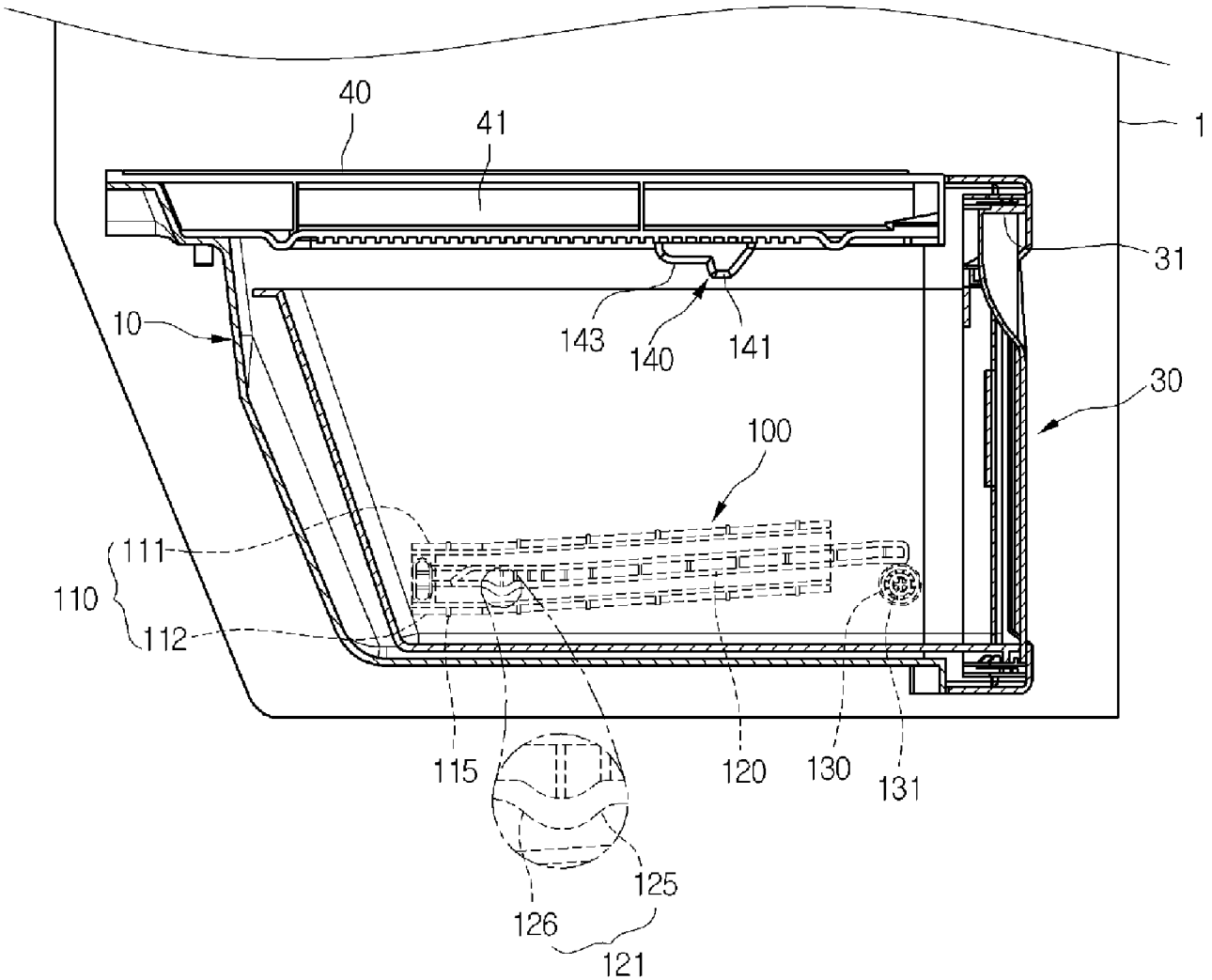

[Fig. 2]
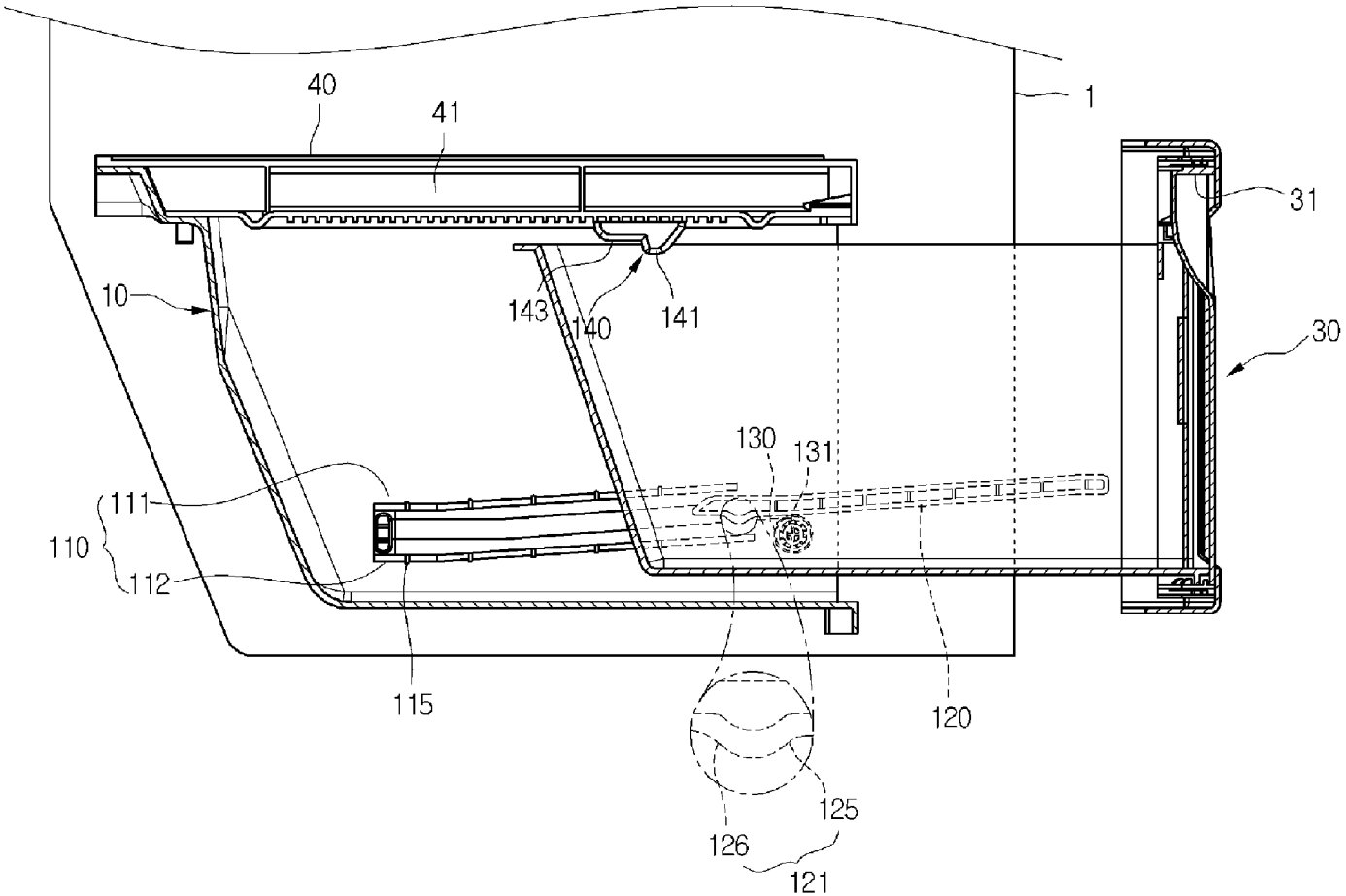

[Fig. 3]
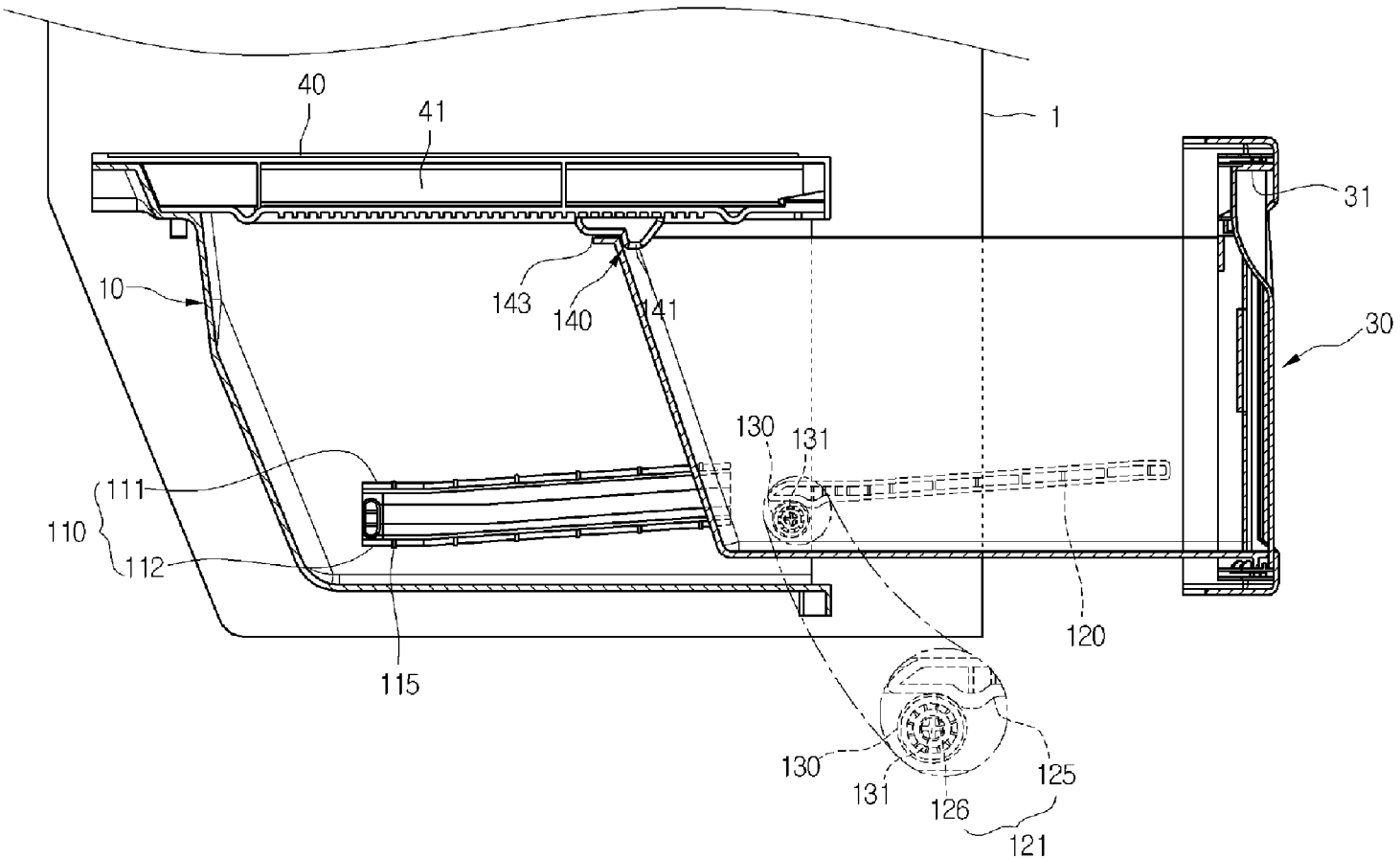

REFRIGERATOR

TECHNICAL FIELD

The present invention relates to a refrigerator that the bin is easily pulled out from the storage space.

BACKGROUND ART

In general, a refrigerator is an appliance storing foods under low temperature. A refrigerator maintains the storage space under low temperature by refrigerant cycle.

A bin is arranged in the storage space of a refrigerator arranged in the storage space as capable of being pulled out. It is possible for the bin to keep vegetables, fruits and other various foods. Users pull the bin out of the refrigerator and push the bin into the storage space after taking out foods stored in the bin. Here, the bin is easily pulled out by a guiding equipment.

However, when the bin is completely pulled out, the bin droops due to the weight of the bin itself and the weight of the foods in the bin. Therefore, it was inconvenient for users to push the drooped bin into the storage space.

Further, the bin breaks away from the guide device when the bin droops down. In this case, users had to push the bin after setting the bin on the guide device.

Furthermore, it was inconvenient for users to take foods out of the bin when the bin was not pulled out sufficiently.

DISCLOSURE OF INVENTION

Technical Problem

An object of the present invention is to provide a refrigerator capable of preventing the drooping of bin even when the bin is pulled out.

Another object of the present invention is to provide a refrigerator that the bin is easily pushed in.

Another object of the present invention is to provide a refrigerator preventing the breaking away of bin from guide device, even when the bin is completely pulled out.

Technical Solution

According to an aspect of the present invention to achieve the above-mentioned objects, there is provided a refrigerator comprising a body having a storage space; a bin arranged as capable of pulled out from the storage space; a guide device arranged in the storage space and guiding the draw of the bin; and a stopper supporting the rear of the bin to prevent inclination of the bin in a side when the bin is pulled out.

According to another aspect of the present invention, there is provided a refrigerator comprising a body having storage space; a bin arranged in the storage space to be pulled out; a guide device arranged in the storage space and guiding the draw of the bin; a stopper supporting the rear of the bin to prevent inclination of the bin when the bin is pulled out; and a roller supporting the guide device and arranged at the front before the stopper.

According to another aspect of the present invention, there is provided a refrigerator comprising a body having storage space; a bin arranged in the storage space to be pulled out; a stopper supporting the rear of the bin to prevent inclination of the bin when the bin is pulled out; a guide rail arranged at the storage space; a roller arranged at the storage space; and a guide rib arranged at the bin, coupled with the guide rail as capable of moving, and having a restriction portion engaged with the roller at the state that the bin is pulled out.

According to another aspect of the present invention, there is provided a refrigerator comprising a body having storage space; a bin arranged in the storage space to be pulled out; a guide rail arranged at the storage space; a guide rib arranged at the bin and engaged with the guide rail as capable of moving; a roller arranged at the storage space; a stopper preventing the inclination of the top of the bin forwardly at the state that the bin is pulled out; and a restriction portion formed at the guide rib and preventing the sink of the rear of the bin downwardly to prevent the drooping down of the bin when the bin is pulled out.

In the above-mentioned preferred embodiments, it is possible for the guide rail to be inclined in the upward against the direction that the bin is pulled out.

It is possible for the stopper to be arranged at the front before the stopper.

It is possible for the stopper to be arranged at the upper part of the bin.

It is possible for the stopper to have an protrusion restricting the top of the bin when the bin is pulled out.

It is possible for the restriction portion to be protruded at the lower part of the guide rib.

Advantageous Effects

According to the present invention, it is effective in that the drooping of the bin is prevented even when the bin is pulled out.

Further, according to the present invention, it is effective in that the bin is easily pushed in, since it is not drooping.

Furthermore, according to the present invention, it is effective in that the breaking away of the bin from the guide device is prevented even when the bin is completely pulled out.

BRIEF DESCRIPTION OF THE DRAWINGS

FIG. 1 is a cross-sectional view illustrating a refrigerator according to the present invention, FIG. 2 is a cross-sectional view illustrating the state that the bin is pulled out of the refrigerator in FIG. 1, FIG. 3 is a cross-sectional view illustrating the state that the bin is completely pulled out of the refrigerator in FIG. 1.

BEST MODE FOR CARRYING OUT THE INVENTION

Reference will now be made in detail as for the present invention with reference to the accompanying drawings. The idea of the present invention is, however, not limited to the above-mentioned preferred embodiment, and new preferred embodiments included in the scope of the idea of the related or present invention can be proposed as adding other compositions, changing and deleting compositions.

Referring to FIG. 1, a casing 10 is arranged in the body 1 of the refrigerator. The casing 10 forms a sort of storage space 20 in substance. The casing 10 contains a bin 30 that can be pulled out and pushed in. a grip 31 that users can grip and pull is formed on the front of the bin 30. The bin 30 is formed in shape of a box that the top is opened. It is possible for this kind of shape of the bin 30 to be changed in various ways in accordance with the shape of the storage space formed by casing 10.

A cover 40 is arranged on the top of the bin 30. The cover 40 is arranged to cover the opened top of the bin 30. A path 41 is formed in the cover 40. Cool air flows through the path 41 to cool the foods stored in the bin 30.

guide devices 100 are arranged in the storage space 20. Here, it is possible for the guide devices 100 to be arranged at the both sides of the storage space 20. It is possible for the guide device 100 to include guide a rail 110 and a guide rib 120.

The guide rail 110 is arranged at the both sides of the storage space 20. The guide rail is arranged as drawing long along the pulling direction of the bin 30. Here, it is possible for the guide rail 100 to be formed in a single structure with the storage space 20, or to be coupled with the both sides of the storage space 20 by separate coupling members.

It is possible for the guide rail 100 to be composed of an upper guide rail 111 and a lower guide rail 112. Here, it is possible for the upper and lower guide rails to be arranged as adjacent to each other in the up and down positions with a predetermined interval. Further, it is possible that a reinforcing reeve 120 are formed the upper and lower guide rails 112 to reinforce the strength.

A moving guide rib 120 is coupled with the guide rail 110. The guide rib 120 is formed at the external of the bin 30. It is possible for the guide rib 120 to be formed as drawing long along the pulling direction of the bin 30.

It is possible for the guide rib 120 to be formed as unified with the bin 30 or to be coupled at the external of the bin by separate coupling members. Here, the guide rib 120 is arranged only at a side of the bin 30 when the guide rail 110 is arranged only at a side of the storage space 20. Further, the guide rib 120 is arranged at both sides of the bin 30 when the guide rail 110 is arranged at both sides of the storage space 20. Furthermore, though it is not illustrated, it is possible that a separate roller 130 is arranged at each of the upper and lower guide rail 112.

It is possible for the guide device 100 to be arranged as inclined against the pulling direction of the bin 30. For instance, it is possible for the guide rail 110 and the guide rib 120 to be arranged as being inclined as the front of the body 1 is relatively higher than the rear of the body 1. Therefore, it is possible to minimize the drooping of the bin when the bin 30 is pulled out of the storage space 20. Furthermore, it is convenient to push the bin 30 into the storage space 20, since the bin 30 is not drooping down.

It is possible that a roller 130 is arranged at the both sides of the storage space 20. Here, it is possible for the roller 130 to be arranged at the front of the guide rail 110 to support the bottom of the guide rib 120 when the bin 30 is pulled out. The roller is installed to be rotated with the rotating shaft 131 as centering. It is possible for the rotating shaft 131 to be arranged at the position almost same to the front end of the lower guide rail 112.

A stopper 140 is arranged at the storage space 20 to support the rear of the bin 30 at the state that the bin is pulled out. For instance, it is possible for the stopper 140 to be arranged to support the rear top of the bin 30 at the state that the bin is pulled out. Further, it is also possible for the stopper 140 to be arranged to support both rear sides of the bin 30 at the state that the bin 30 is pulled out. The stopper 140 as above prevents the drooping down of the bin 30 at the state that the bin 30 is pulled out.

It is possible that an protrusion 141 is formed at the front of the stopper 140. The protrusion 141 restricts the top of the bin 30 when the bin 30 pulled out of the storage space 20 is about to be drooping down. Therefore, the protrusion 141 prevents the drooping of the bin 30 even when the bin 30 is pulled out, and also prevents the separation of the guide rib 120 from the guide rail 110.

An inclined part 142 is formed at the front of the protrusion 141. The inclined part 142 let the bin 30 be smoothly moved when pushing the bin 30 into the storage space 20 after washing the bin.

Further, a supporting unit 143 is formed at the rear of the stopper 140. The supporting unit 143 supports the rear top of the bin 30 at the state that the bin 30 is pulled out.

Furthermore, it is possible for the roller 130 to be arranged before the stopper at the front. Here, the stopper 140 restricts the top of the bin 30 after the rotating shaft of the bin at the rear, when the bin 30 is about to be rotated with the roller 130 as the rotating center at the state that the bin 30 is pulled out. Therefore, it is prevented that the bin is drooping down as rotated.

Further, it is possible that a restriction portion 121 is formed at the guide rail 110 to prevent the bottom of the bin 30 going backward at the state that the bin 30 is pulled out. It is possible for the restriction portion 121 to be protruded at the lower side of the guide rail 110. Therefore, the restriction portion 121 is arranged at the front of the roller 130 when the bin is completely pulled out. It is possible for the restriction portion 121 to be rounded so as to cross along the roller 130 when the bin 30 is pulled out. A first guide unit 125 is formed at the front end of the restriction portion 121. The first guide unit 125 leads the roller 130 to cross along the restriction portion 121 when the bin 30 is pulled out of the storage space 20.

Further, a second guide unit 126 is formed at the rear of the restriction portion 121. The second guide unit 126 leads the roller 130 to cross along the restriction portion 121 when the bin 30 is pushed into the storage space 20. Furthermore, the roller 130 prevents that the second guiding unit 126 is pushed back, since the roller 130 is engaged with the second guiding unit 126 when the bin 30 is pulled out of the storage space 20. Therefore, the bin stays as inclined upwardly.

It is advisable for the first and the second guide units 126 to be formed as symmetrized against each other. Therefore, it is minimized that the roller is interfered by restriction portion 121 at the process that the bin 30 is pulled out.

It is possible for the bottom of the bin 30 to be adjacent to the bottom of the storage space 20 at the state that the bin 30 is arranged in the inside of the storage space 20.

Reference will now be made in detail as for the operation of the preferred embodiment of a refrigerator according to the present invention.

The process that the bin 30 is pulled out is illustrated in FIGS. 3 and 4.

Referring to FIG. 2, the bin 30 is pulled out toward the front of the storage space 20 when a user pulls the grip of the bin 30. The guide rib 120 moves along the guide rail 110 as sliding with the bin 30. The roller 130 supporting the guide rib 120 is rotated as the guide rib 120 is moved. Here, the bin 30 is pulled out as a little inclined upwardly, since the guide rail 110 and the guide rib 120 are arranged to be inclined upwardly.

Referring to FIG. 3, the guide rib 120 completely separated from the guide rail 110 when the bin 30 keeps pulled out of the storage space 20. Here, the roller 130 is rotated along the first guide unit 125 of the restriction portion 121. The restriction portion 121 is engaged with the roller 130 when the bin 30 is pulled out till the roller contacts the second guide unit 126 of the restriction portion 121. At the same time, the rear top of the bin 30 is engaged with the protrusion 141 of the stopper 140. Here, a rotating torque with the roller as rotating center by the weight of bin and the weight of foods contained is engaged with the bin 30. However, the bin 30 is not rotated with the roller as centering, but is maintained as inclined upwardly, since the restriction portion 121 arranged at the lower side of the bin 30 is at the state engaged with roller 130 and the rear top of the bin 30 is engaged with the protrusion 141 of the stopper 140. Therefore, it is prevented that the bin 30 is drooping down when it is pulled out of the storage space 20. Further, the inconvenience suiting the guide rib 120 on the guide rail 110 when users push the bin 30 back into the storage space 20 is overcome, since it is prevented that the bin 30 is completely pulled out and separated from the guide device 100.

INDUSTRIAL APPLICABILITY

The industrial applicability of the refrigerator according to the present invention configured as above is very high as the bin of the refrigerator is effectively pulled out.

The invention claimed is:

1. A refrigerator comprising:

a body having a storage space;

a case provided in the storage space;

a cover covering an upper part of the case;

a bin arranged in a space defined by the case and the cover, the bin configured to be pulled out;

a guide rail arranged at the case and inclined upwardly against the pulling direction of the bin;

a guide rib arranged at the bin, the guide rib extending a predetermined length to be accommodated within the guide rail such that the guide rib is movable along the guide rail;

a roller arranged at the case and disposed apart from the front end of the guide rail to support the guide rib when the bin is pulled out;

a stopper arranged at a lower surface of the cover to prevent a top of the bin from being completely separated from the case; and a restriction portion downwardly protruded at the guide rib, wherein the guide rib is continuously maintained in contact with the roller, and the guide rib is configured to be longer than the guide rail, wherein the stopper includes:

a protrusion formed at a front of the stopper to restrict the top of the bin when the bin is pulled out of the storage space;

an inclined part formed at a front of the protrusion to allow the bin to be smoothly moved when the bin is pushed into the storage space; and a supporting unit formed at the rear of the stopper to support the rear top of the bin when the bin is pulled out.

2. The refrigerator according to claim 1, wherein the stopper protrudes into an interior of the bin.

3. The refrigerator according to claim 1, wherein the roller is arranged before the stopper toward the front of the refrigerator.

4. The refrigerator according to claim 3, wherein the stopper contacts the bin and the roller contacts the restriction portion in order to prevent the drooping of the bin when the bin is completely pulled out.

5. The refrigerator according to claim 1, wherein the restriction portion is formed as a rounded shape to allow the restriction portion to cross over the roller when the bin is pulled out.

6. The refrigerator according to claim 1, wherein the cover is disposed on the top of the bin to cover an open top of the bin.

7. The refrigerator according to claim 6, wherein a path is formed in the cover to supply a cool air to the bin through the path.

8. The refrigerator according to claim 6, wherein the stopper is formed on a bottom surface of the cover.

* * * * *